US009454123B2

(12) United States Patent
Sugiyama

(10) Patent No.: US 9,454,123 B2
(45) Date of Patent: Sep. 27, 2016

(54) ERASING APPARATUS AND COOLING METHOD

(71) Applicants: Kabushiki Kaisha Toshiba, Tokyo (JP); Toshiba Tec Kabushiki Kaisha, Tokyo (JP)

(72) Inventor: Hiroyuki Sugiyama, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 498 days.

(21) Appl. No.: 14/019,307

(22) Filed: Sep. 5, 2013

(65) Prior Publication Data

US 2015/0064638 A1 Mar. 5, 2015

(51) Int. Cl.

| | |
|---|---|
| ***B41J 29/377*** | (2006.01) |
| ***G03G 21/00*** | (2006.01) |
| *B41M 7/00* | (2006.01) |

(52) U.S. Cl.

CPC ..... *G03G 21/00* (2013.01); *B41M 7/0009* (2013.01)

(58) Field of Classification Search

CPC ..... B41J 2002/4756; B41J 29/377

See application file for complete search history.

(56) References Cited

U.S. PATENT DOCUMENTS

| | | | | |
|---|---|---|---|---|
| 2010/0141725 | A1* | 6/2010 | Shiohara | B41J 11/0015 347/102 |
| 2010/0196063 | A1* | 8/2010 | Iguchi | B41J 3/546 399/322 |
| 2011/0037820 | A1* | 2/2011 | Brewington | B41J 2/4753 347/179 |
| 2012/0306985 | A1 | 12/2012 | Iguchi et al. | |

FOREIGN PATENT DOCUMENTS

| | | |
|---|---|---|
| JP | 2005-169677 | 6/2005 |
| JP | 2013-119255 | 6/2013 |

* cited by examiner

*Primary Examiner* — Geoffrey Mruk
*Assistant Examiner* — Scott A Richmond
(74) *Attorney, Agent, or Firm* — Patterson & Sheridan, LLP

(57) ABSTRACT

An erasing apparatus includes a path configured to carry a sheet, and an erasing unit arranged on the path and configured to erase an image on the sheet by heating the sheet. The erasing apparatus further includes a fan configured to blow air downstream from the erasing unit in a sheet carrying direction, and a shutter disposed between the fan and the erasing unit and movable to control the amount of air blown by the fan from reaching the erasing unit.

9 Claims, 6 Drawing Sheets

ERASING APPARATUS AND COOLING METHOD

FIELD

Embodiments described in this specification relate to an erasing apparatus which erases an image formed on a sheet by heating the sheet.

BACKGROUND

There is an erasing apparatus which erases an image that has been printed on a sheet with erasable toner or ink, by heating the sheet to a temperature higher than a predetermined temperature, in order to reuse the sheet.

In some cases, an erasing apparatus includes a reading unit to digitize an image on a sheet before erasing and store the image. The stored image may be used to determine the presence of some image left after erasing and then to separate a reusable sheet and a non-reusable sheet. This erasing apparatus includes a cycle path for a reading unit performing the digitization and separation after erasing. The cycle path branches from a main path (i.e., a path from a sheet feed tray to a discharge tray) on the downstream side in the sheet carrying direction from the reading unit, and merges into the main path on the upstream side in the sheet carrying direction from the reading unit. The cycle path includes an erasing unit.

The operation of this erasing apparatus will be described. The reading unit reads a sheet supplied from a sheet supply unit and digitizes it. The sheet enters the cycle path and the erasing unit erases the image on the sheet by heating the sheet. Then, the sheet enters the main path and the reading unit reads the sheet again. According to the result of subsequent reading, the sheet is conveyed to a reusable tray or a non-reusable tray.

The temperature of the surface of a sheet gets higher after passing through the erasing unit. When the reading unit reads the heated sheet, the heat may introduce noise and/or hasten the deterioration of the reading unit. A fan may be installed between the erasing unit and the reading unit. The fan cools the sheet passing through the path while blowing air. However, because the fan is between the erasing unit and the reading unit, cooling air from the fan also goes to the erasing unit along the path. As the result, the temperature of the erasing unit drops, which may cause an erasing failure.

DETAILED DESCRIPTION

Embodiments provide a technique to restrain the cooling of the erasing unit, by inhibiting the cooling air from reaching the erasing unit.

The erasing apparatus according to embodiments includes a path, an erasing unit, fans, and shutter members. Sheets are carried through the path. The erasing unit is arranged on the path and erases an image formed on the sheet with heat added to the sheet. The fans blow air to a position in the path that is downstream from the erasing unit in the sheet carrying direction. The shutter members are arranged between the fans and the erasing unit. The shutter members are arranged so that one end of each shutter can be moved to a position which is in contact with or close to the path to affect the air flow from the fan to the erasing unit.

The erasing apparatus according to an embodiment includes fans for cooling the surface of a sheet after the sheet passes through an erasing unit. The fans are positioned downstream of the erasing unit in the sheet carrying path, and face the direction along which cooling air is blown in the path. The cooling air from the fans flows into and then along the path. Therefore, the air flows not only downstream along the path but also away from the erasing unit.

The erasing apparatus according to the embodiment has shutter members between the fans and the erasing unit. Each shutter member is a plate-shaped member and may be formed from any suitable material. One surface of the shutter member faces the erasing unit and the other surface of the shutter member faces the fan. At least one side of the shutter member (distal ends 71 and 72 described later) is positioned close to the path. As this side moves closer to the path, the space between the path and the shutter member becomes smaller and the cooling air flowing in the upstream direction (toward the erasing unit) is shut down or restricted by the shutter member. Therefore, the temperature drop in the erasing unit by the cooling air can be restrained.

The position of the shutter member can be changed slidably between the first position where one end (distal ends 71 and 72 described later) is close to the path and the second position where it is away from the path. At the close position, cooling air can be prevented from flowing to the erasing unit, as mentioned above. On the other hand, at the away position, cooling air is not hindered from flowing to the erasing unit. When the erasing unit has to be cooled, the erasing apparatus can slidably move the shutter members to the away position, to permit the air from the fans to flow to the erasing unit.

Figure 1:
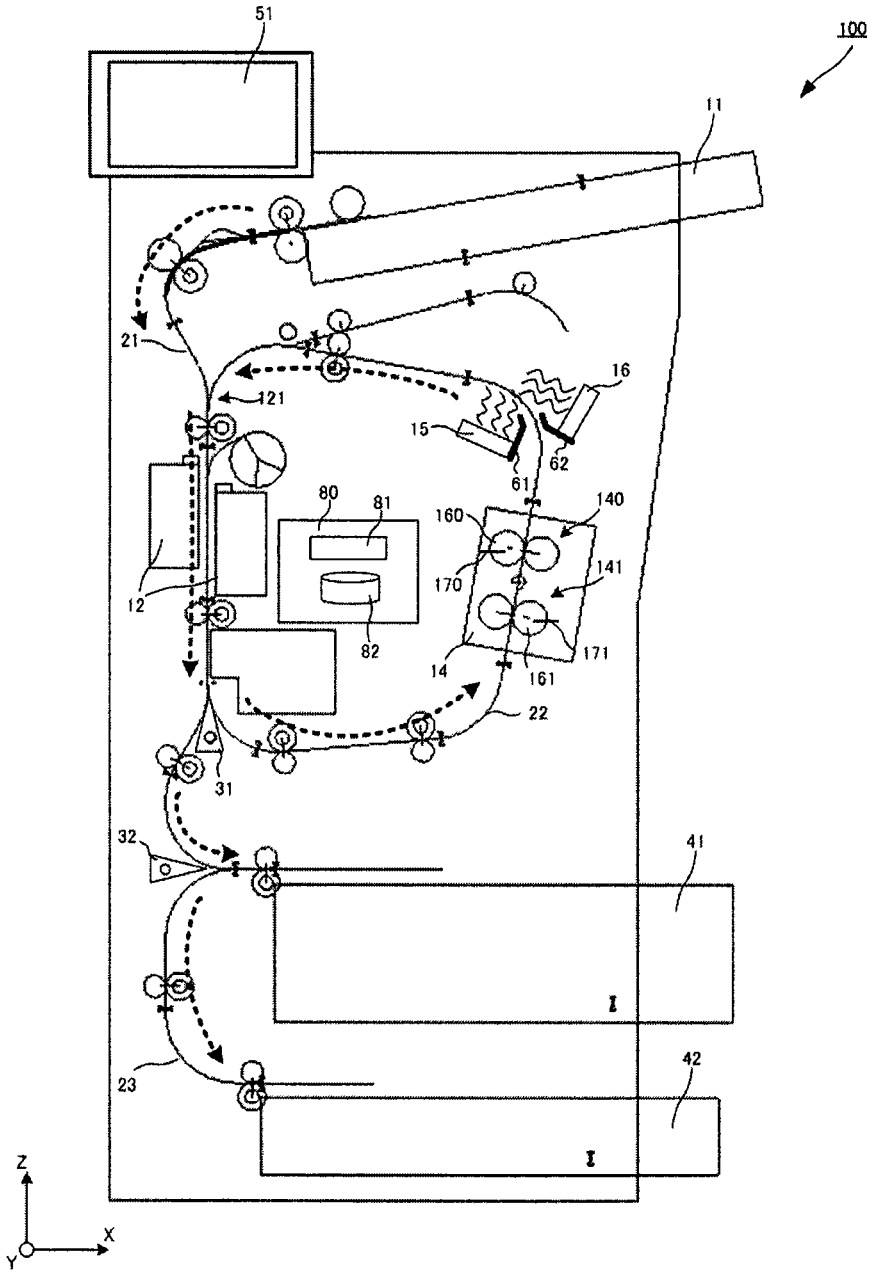
FIG. 1 is a schematic view showing an example structure of an erasing apparatus.

Hereinafter, the embodiment will be described with reference to the drawings. FIG. 1 is a schematic view of the erasing apparatus according to an embodiment. The sheet carrying direction is indicated by arrows with dotted lines. A starting point of the arrow is upstream in the sheet carrying direction and an end point (arrow head) is downstream.

The erasing apparatus 100 includes a feed tray 11, a reading unit 12, an erasing unit 14, fans 15 and 16, a first path 21, a second path 22, a third path 23, a first branch member 31, a second branch member 32, a first tray 41, a second tray 42, an operation unit 51, and shutter members 61 and 62. The respective operations of the hardware are controlled by a controller 80 within the erasing apparatus 100.

The feed tray 11 accepts and stacks sheets for reuse. The feed tray 11 stacks sheets of various sizes such as A4, A3, B5, and the like. The sheets to be stacked on the feed tray 11 have images formed with a recording material (toner or ink) that can be erased, for example, by heating them to a temperature higher than a predetermined temperature. The feed tray 11 includes a pickup roller, a sheet feed roller, and a separation roller facing the sheet feed roller. By using these rollers, the feed tray 11 feeds the sheets one by one to the first path 21.

The first path 21 forms a path going from the feed tray 11 to the first tray 41. The first path 21 carries a supplied sheet to the reading unit 12.

The reading unit 12 is arranged along the first path 21 downstream from the feed tray 11. The reading unit 12 includes a reading device, for example, a CCD (Charge Coupled Device) scanner or a CMOS sensor. In this embodiment, the reading unit 12 includes two reading devices, each of which is arranged on opposite sides of the first path 21. Thus, images on the both sides of a carried sheet can be read. A memory 82 of the controller 80 described later stores the image read by the reading unit 12. The image before erasing is read and digitized by the reading unit 12, and stored in the memory 82 by the controller 80. When the data of the erased image becomes necessary afterward, the image data is obtained from the memory 82. Further, the image data read by the reading unit 12 is used for checking whether a sheet is reusable or not after the erasing.

The first branch member 31 is arranged downstream from the reading unit 12 as a switching unit for the path. The first branch member 31 switches the carrying direction of a carried sheet. The first branch member 31 switches a carrying direction of a sheet towards the second path 22 or toward the first tray 41. Thus, the sheet having been carried in the first path 21 is carried to the second path 22 or to the first tray 41, depending on the first branch member 31. The second path 22 is branched from the first path 21 at a branch point where the first branch member 31 is arranged. The second path 22 is branched from the branch point to carry a sheet to the erasing unit 14. The second path 22 merges with the first path 21 at a meeting point 121 upstream from the reading unit 12. The second path 22 becomes a cycle path for transferring a sheet carried from the reading unit 12 via the erasing unit 14 and again carrying it to the reading unit 12. In other words, the erasing apparatus 100 can transfer a sheet supplied from the feed tray 11 to the reading unit 12, the erasing unit 14, and the reading unit 12, in this order, by controlling the first branch member 31.

The first path 21 includes the second branch member 32 arranged downstream from the first branch member 31. The second branch member 32 guides a sheet carried from the first branch member 31 to the first tray 41 or the third path 23. The third path 23 carries a sheet to the second tray 42.

The erasing unit 14 erases the image on a carried sheet. The erasing unit 14 heats the carried sheet above a predetermined temperature for removing the color. The erasing unit 14 thus removes the color of the image formed on the sheet with a recording material. The erasing unit 14 includes two color removing units 140 and 141 for respectively erasing a first surface and a second surface of the sheet. The color removing units 140 and 141 have heating elements 160 and 161 which are heated by the supplied power and are arranged along the second path 22. The color removing unit 140 abuts the sheet on one surface thereof and heats it. The color removing unit 141 abuts the other surface of the sheet and heats it. In this manner, the erasing unit 14 removes the color of the image from both surfaces of the carried sheet at approximately the same time.

The erasing unit 14 includes a temperature sensor 170 which detects the temperature of the heater lamp 160 and a temperature sensor 171 which detects the temperature of the heater lamp 161. The temperature information detected by the temperature sensors 170 and 171 is supplied to the controller 80. The controller 80 controls the temperature of the heater lamps 160 and 161, according to the temperature information.

The operation unit 51 is mounted on the top of the main body of the erasing apparatus 100 and includes a touch panel display and an operation keypad (for example, a numeric or alphanumeric keypad). A user instructs the operation of the erasing apparatus 100, such as erasing start or reading of an image on a sheet to be erased, through the operation unit 51. The operation unit 51 displays the setting information, operational status, log information of the erasing apparatus 100 or a message for a user.

The first tray 41 accepts and stacks the sheets which are reusable after the images on the sheets are erased. The second tray 42 accepts and stacks the sheets determined as non-reusable. The destination of the sheets can be switched between the first tray 41 and the second tray 42. The operation unit 51 sets which tray to stack what sheet, according to the user's input. In other words, the user can set the transport destination of each sheet. According to the setting, the second branch member 32 switches the path to guide the carried sheet to the first tray 41 or the third path 23 (and ultimately the second tray 42).

The fan 15 is arranged to blow cooling air to one surface of the second path 22. The fan 16 is arranged to blow cooling air to the other surface of the second path 22. The fans 15 and 16 are positioned downstream from the erasing unit 14 and upstream from the meeting point 121. That is, the fans 15 and 16 are positioned upstream from the reading unit 12 in a route passing through the second path 22. The surface of the second path 22 which is cooled by the cooling air from the fans 15 and 16 includes a plurality of slits. A sheet passing through inside of the second path 22 directly receives the cooling air from the slits. Accordingly, by the time when the sheet arrives at the reading unit 12, the sheet is cooled.

The fans 15 and 16 blow air to the path between the erasing unit 14 and the reading unit 12, as illustrated in FIG. 1. The path distance from the erasing unit 14 to the fans 15 and 16 is shorter than the path distance from the fans 15 and 16 to the reading unit 12. In other words, the fans 15 and 16 are positioned nearer to the erasing unit 14 than to the reading unit 12. The path portion positioned downstream from the erasing unit 14 in the sheet carrying direction, where the heated sheets are constantly transferred, may be heated by the heat transmitted from the above sheets. The fans 15 and 16 blow the air to the path, thus cooling not only the carried sheets but also the path itself. Accordingly, the fans 15 and 16 are positioned in the vicinity of the path portion positioned downstream from the erasing unit 14 in the sheet carrying direction, which makes it possible to cool not only the sheets but also the path to be heated.

The shutter members 61 and 62 are arranged between the fans 15 and 16 and the erasing unit 14. The detail of this structure will be described later.

The controller 80 includes a processor 81 and the memory 82. The processor 81 is a CPU (Central Processing Unit) or MPU (Micro Processing Unit). The processor 81 loads a program previously recorded in the memory 82 and executes calculations and operations according to the program. Thus, the processor 81 controls the hardware. The memory 82 is, for example, a semiconductor memory and it includes a ROM (Read Only Memory) which stores various control programs and a RAM (Random Access Memory) which provides the processor with a temporary working region.

Further, the memory 82 includes HDD (Hard Disk Drive) which persistently stores the image data read by the reading unit 12.

Figure 2:
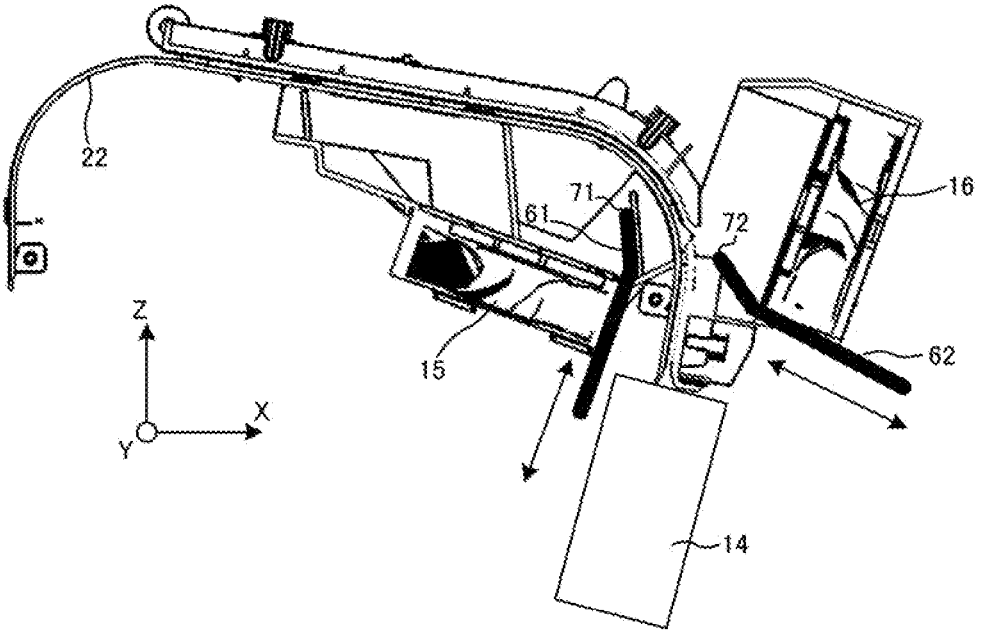
FIG. 2 is an illustration showing fans and shutter members in the erasing apparatus when the shutter members are open.
Figure 3:
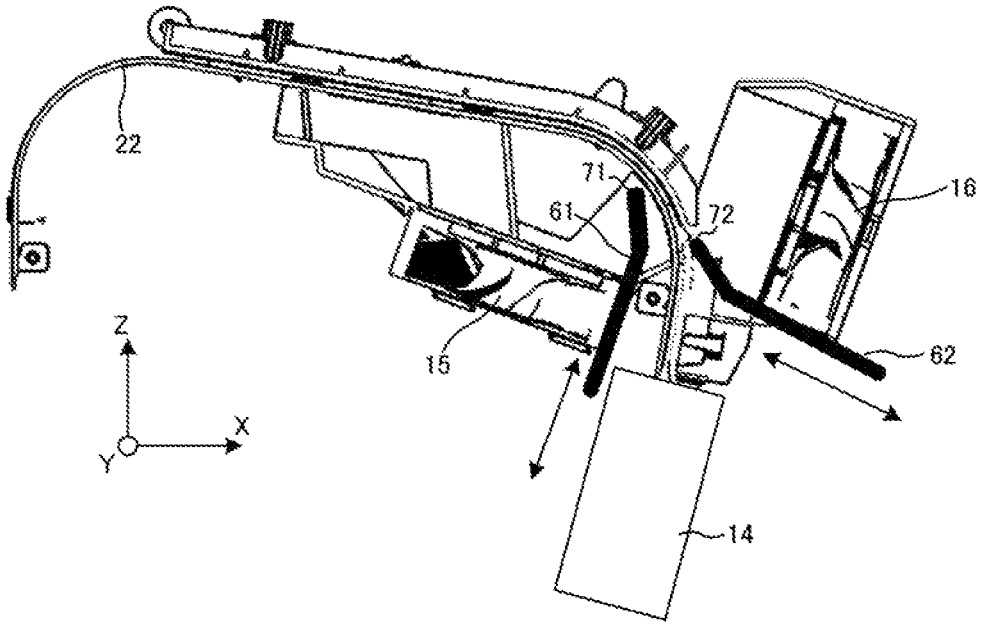
FIG. 3 is an illustration showing the fans and the shutter members when the shutter members are closed.

FIGS. 2 and 3 are enlarged views of the vicinity of the fans 15 and 16. The fans 15 and 16 are fixed to the body of the erasing apparatus 100, so that each blows cooling air to opposite surfaces of the second path 22. The shutter member 61 is arranged proximate to the fan 15 and the shutter member 62 is arranged proximate to the fan 16. The shutter members 61 and 62 are movable in an arrow direction shown in FIG. 2. The shutter members 61 and 62 move according to the instruction of the controller 80. Namely, the shutter members 61 and 62 can slide from a first state (referred to as an open state) shown in FIG. 2 to a second state (referred to as a closed state) shown in FIG. 3. In the case of the open state, as illustrated in FIG. 2, the distal end 71 of the shutter member 61 and the distal end 72 of the shutter member 62 are both positioned away from the second path 22. In the case of the open state, air from the fans blows to the surfaces of the bent portions of the shutter members 61 and 62.

Compared with the position of the distal end 71 of the shutter member 61 and the distal end 72 of the shutter member 62 to the second path 22 in the open state (FIG. 2), the distal end 71 of the shutter member 61 and the distal end 72 of the shutter member 62 are both nearer to the second path 22 in the closed state, as illustrated in FIG. 3. In the closed state, the distal ends 71 and 72 may be in contact with the second path 22.

An edge of the distal end 71 of shutter member 61 is bent downstream along the second path 22. An edge of the distal end 72 of shutter member 62 is also bent downstream along the second path 22. The shutter members 61 and 62 are bent at their ends on the path side opposite to the erasing unit 14. They may be bent, as illustrated in FIGS. 2 and 3, or may be moderately curved along an arc.

Figure 4:
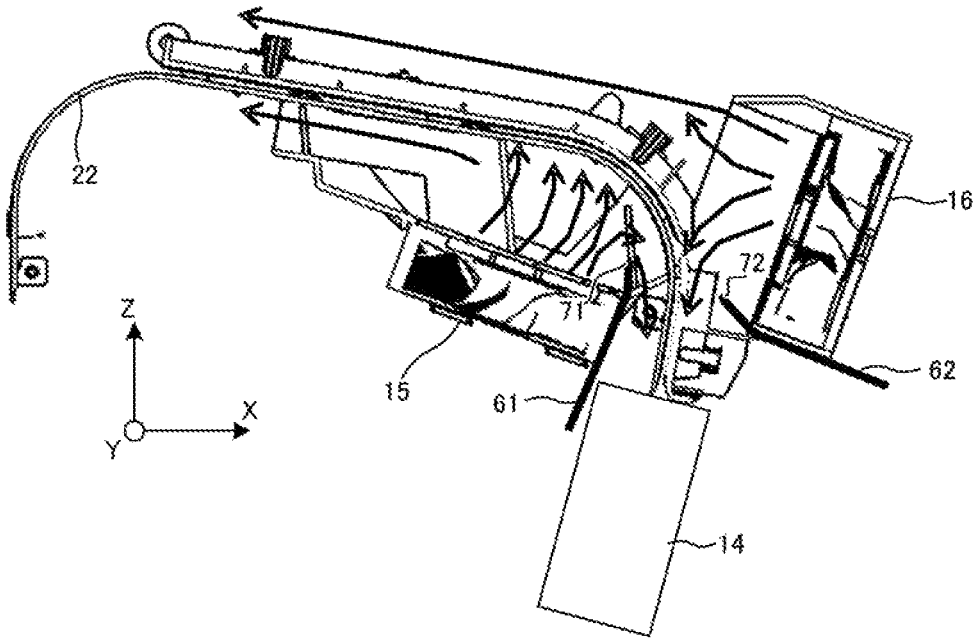
FIG. 4 is an illustration showing an example of cooling air flow when the shutter members are open.
Figure 5:
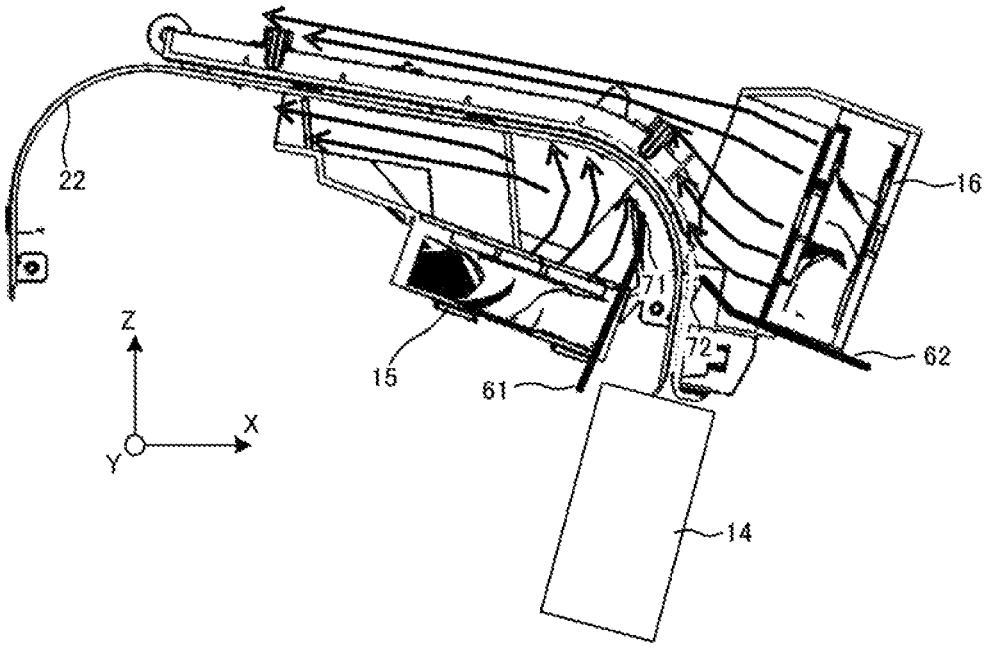
FIG. 5 is an illustration showing an example of cooling air flow when the shutter members are closed.

FIG. 4 is an illustration showing an example of the flow of cooling air indicated by an arrow, when the shutter members 61 and 62 are in the open state. FIG. 5 is an illustration showing an example of the flow of cooling air indicated by an arrow, when the shutter members 61 and 62 are in the closed state. When the shutter members 61 and 62 are in the open state shown in FIG. 4, the cooling air from the fans 15 and 16 flows along the surface of the second path 22 not only in the downstream direction of carrying sheets but also to the erasing unit 14 that is positioned upstream, because the air flow is not blocked by the shutter members 61 and 62. According to this, the erasing unit 14 can also be cooled. On the other hand, when the shutter member are in the closed state shown in FIG. 5, the cooling air from the fans 15 and 16 does not enter (or is substantially prevented from entering) into the erasing unit 14. The cooling air from the fans 15 and 16 is blocked by the shutter members 61 and 62 and is directed to the downstream side of the second path 22. Accordingly, the temperature drop of the erasing unit 14 in the erasing operation can be maintained, and efficient cooling for the second path 22 and the sheets is enabled. Because the edge of the distal end 71 and the edge of the distal end 72 are bent downstream, a downstream flow of the cooling air in the sheet carrying direction is promoted and a flow in the upstream direction to the erasing unit 14 is restricted.

Figure 6:
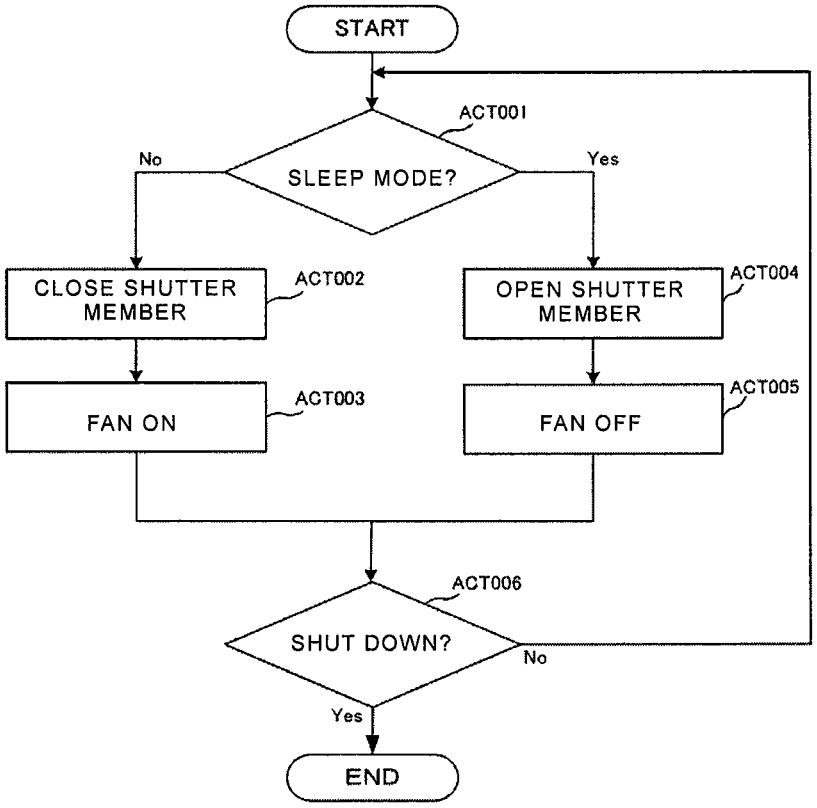
FIG. 6 is a flow chart showing example operations of a control unit of the erasing apparatus.

FIG. 6 is a flowchart showing example operations of the erasing apparatus 100 by the processor 81. The processor 81 determines whether the erasing apparatus 100 is currently in a sleep mode or not (ACT 001). In the embodiment, the memory 82 stores a value indicating each mode of the erasing apparatus 100. Based on the stored value, the processor 81 determines whether erasing apparatus 100 is in the sleep mode or not. The sleep mode in the embodiment means the erasing apparatus 100 is in a power saving mode while keeping the stored state (e.g., setting mode of the erasing apparatus 100) in the memory 82. In the sleep mode, the power supply unit within the erasing apparatus 100 restricts or stops a power supply to, for example, the respective paths, the reading unit 12, the erasing unit 14, the operation unit 51, and the controller 80 (especially, the processor 81).

The erasing apparatus 100 may exit the sleep mode during specific events such as: when a sheet is carried along the path 21, when the sheet is subjected to various kinds of process such as reading of an image in the reading unit 12 or erasing of the image on the sheet in the erasing unit 14, when a power is turned on, while waiting for an instruction of color removing job, or while in a standby mode, When the erasing apparatus 100 is not in the sleep mode (No in ACT 001), the processor 81 controls the shutter members 61 and 62 to be in a closed state (ACT 002). In ACT 002, if the shutter members 61 and 62 are already in the closed state, the state is maintained. If the shutter members 61 and 62 are in the open state at ACT 002, the processor 81 controls the shutter members 61 and 62 to be in the closed state. The processor 81 then turns on the fans 15 and 16 (ACT 003). If they are already in the ON mode at ACT 003, the processor 81 maintains the ON mode of the fans. If the fans 15 and 16 are in the OFF mode at ACT 003, the processor 81 controls them to be in the ON mode.

On the other hand, in ACT 001, if the erasing apparatus 100 is in the sleep mode (Yes in ACT 001), the processor 81 controls the shutter members 61 and 62 to be in the open state (ACT 004). In ACT 004, if the shutter members 61 and 62 are already in the open state, this state is maintained. If the shutter members 61 and 62 are in the closed state at ACT 004, the processor 81 controls the shutter members 61 and 62 to be in the open state. After a predetermined period of time from ACT 004, the processor 81 turns off the fans 15 and 16 (ACT 005). The predetermined period from ACT 004 is a period for cooling the erasing unit 14, which is a designed value previously defined. This predetermined period can be changed according to an input from the operation unit 51. The OFF operation in ACT 005 is an operation for saving power in the sleep mode. Further, in ACT 005, when the fans 15 and 16 are already in the OFF mode, the processor 81 maintains the OFF mode. When the fans 15 and 16 are in the ON mode at ACT 005, the processor 81 controls them to be OFF.

The determination in ACT 001, and the operations in ACT 002 and ACT 003 or the operations in ACT 004 and ACT 005 are repeatedly performed (loop of No in ACT 006) until, for example, the power button is pushed down and a shutdown command is issued. When the shutdown command is issued (Yes in ACT 006), the operations are finished.

According to the structure of the embodiment, a flowing direction of the cooling air from the fan can be controlled and the temperature drop in the erasing unit can be avoided. Therefore, it is possible to efficiently cool the surface of a sheet after passing through the erasing unit and the inside of the sheet carrying path for cooling the path.

In the above description, the controller 80 can control the shutter members 61 and 62 in a movable way, so as to be stopped at two positions of the open state and the closed state, but the shutter members 61 and 62 are not restricted to this description. For example, in an alternative embodiment, the shutter members 61 and 62 may be fixed in a non-movable way. In such an embodiment, the shutter members

61 and 62 are fixed at the position of the closed state described above (refer to FIGS. 3 and 5).

In the above description, the controller 80 controls the shutter members 61 and 62 to be moved to the two positions of the open state and the closed state and stopped there. However, according to another embodiment, the shutter members 61 and 62 may be stopped at some position (e.g., a position previously defined by a user) between the open position and the closed position. According to this embodiment, the flow of the cooling air can be further adjusted. The control of the positions of the shutter members 61 and 62 may be performed based on the temperature information detected by the temperature sensors 170 and 171 within the erasing unit 14. Accordingly, as the temperature detected by the temperature sensors 170 and 171 is higher, the controller 80 controls the shutter members 61 and 62 to be stopped at a position nearer to the open state position. For example, a correspondence of the temperature information and the information on the stopped position of the shutter members 61 and 62 may be previously stored in the memory 82. The controller 80 regularly obtains the temperature information from the temperature sensors 170 and 171 and controls the positions of the shutter members 61 and 62, according to the correspondence information previously stored in the memory 82.

The above description has been made in the case where the apparatus is provided with the two fans 15 and 16; the fan 15 blows air to one surface of the second path 22 and the fan 16 blows air to the other surface of the second path 22. Further, it is also provided with the shutter members 61 and 62 corresponding to the fans 15 and 16. Thus, the description has been made of two sets of fan and shutter member. However, in an alternative embodiment, one set of fan and shutter member may be provided.

As set forth above, the technique described in this specification can control the flow of the air from the fan for cooling the sheet heated by the erasing unit.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An erasing apparatus comprising:

a path along which a sheet is to be carried;

an erasing unit arranged on the path and configured to erase an image on the sheet by heating the sheet;

a fan configured to blow air to a position on the path that is downstream from the erasing unit in a sheet carrying direction; and a shutter disposed between the fan and the erasing unit and movable between a first position in which one end thereof is proximate to the path and a second position in which the one end is away from the path.

2. The erasing apparatus according to claim 1, wherein the shutter is configured to substantially block air blown by the fan from flowing to the erasing unit while in the first position and allow the air blown by the fan to flow to the erasing unit while in the second position.

3. The erasing apparatus according to claim 2, further comprising:

a controller configured to control the shutter to be moved between the first position and the second position.

4. The erasing apparatus according to claim 3, wherein the controller is configured to control the shutter to be in the second position when the erasing apparatus is in a sleep mode and in the first position when the erasing apparatus is not in a sleep mode.

5. The erasing apparatus according to claim 1, wherein the shutter is bent so that the one end directed downstream in the sheet carrying direction of the path.

6. The erasing apparatus according to claim 1, wherein the fan comprises a first fan configured to blow air onto a first surface of the path, and the shutter comprises a first shutter located between the first fan and the erasing unit, the erasing apparatus further comprising:

a second fan configured to blow air onto a second surface of the path; and a second shutter located between the second fan and the erasing unit.

7. The erasing apparatus according to claim 1, further comprising:

a reading unit configured to read an image on a surface of a carried sheet, wherein the path is configured to carry a sheet from the erasing unit to the reading unit, and the fan is configured to blow air to a part of the path between the erasing unit and the reading unit.

8. The erasing apparatus according to claim 7, wherein the fan is located closer to the erasing unit than to the reading unit.

9. The erasing apparatus according to claim 1, further comprising:

a detecting unit configured to detect a temperature of a heating element in the erasing unit, wherein the controller is configured to control the shutter according to a temperature detected by the detecting unit.

* * * * *